US005109146A

United States Patent [19]

Maenishi

[11] Patent Number: 5,109,146

[45] Date of Patent: Apr. 28, 1992

[54] SWITCH WITH CONTACTS

[75] Inventor: Kozo Maenishi, Nagaokakyo, Japan

[73] Assignee: Omron Tateisi Electronics Co., Kyoto, Japan

[21] Appl. No.: 349,219

[22] Filed: May 8, 1989

[30] Foreign Application Priority Data

May 11, 1988 [JP] Japan ..... 63-115063

[51] Int. Cl.[5] ..... H01H 33/18; H01H 9/46

[52] U.S. Cl. ..... 200/147 A; 200/147 B; 335/201

[58] Field of Search ..... 200/147 A, 147 B; 335/201

[56] References Cited

U.S. PATENT DOCUMENTS

| | | | |
|---|---|---|---|
| 1,862,631 | 6/1932 | Penn | 200/147 R |
| 2,571,951 | 12/1951 | Schaelchlin | 200/147 A |
| 2,733,312 | 11/1956 | Christensen | 335/201 |
| 3,064,104 | 11/1962 | Wells et al. | 200/147 A |
| 4,489,225 | 12/1984 | Masuda et al. | 200/147 R |
| 4,568,805 | 2/1986 | Wycklendt | 200/147 B |

FOREIGN PATENT DOCUMENTS

| | | | |
|---|---|---|---|
| 1541532 | 10/1967 | France | 200/147 A |

*Primary Examiner*—Steven L. Stephan
*Assistant Examiner*—Nilay H. Vyas
*Attorney, Agent, or Firm*—Fish & Richardson

[57] ABSTRACT

There is provided a switch with contacts comprising: movable contact members (37A, 37B) which are made of leaf springs and are arranged along fixed contact members (29A, 29B); movable contacts (39A, 39B) fixed to the tip portions of the movable contact member so as to face fixed contacts (30A, 30B) fixed to the tip portions of the fixed contact members; and movable side fixed terminal members (35A, 35B) whose base end portions are joined to the base end portions of the movable contact members, wherein projecting portions (31A, 31B) which extend to the front side are formed at the tips of the fixed contact members and the tips of the movable side fixed terminal members are extended to the front side than the contact position. A pair of magnetic pole plates (50A, 50B, 51A, 51B) which face each other are arranged on both sides of the contact position along the front to back direction, respectively.

6 Claims, 7 Drawing Sheets 14A
18A
23A
21
16A
17A
21a
23B
11A
22
21b
15A
12A
13A
19
25A
36A
10A
12B
41A
37A
35A
4
39A
38A
8b
10B
8
13B
42A
5b
7
17B
40A
3
6
20
16B
18B
26A
28A
8a
14B
27c
27a
15B
11B
33A
28B
27
29A
26B
24A
27b
31A
30A
34A
33B
43A
27d
32A
30B
34B
31B
32B
29B
36B
24B
25B
35B
37B
38B
39B
41B
42B
46A
40B
1
2
45A
43B
46B
50A
45B
44A
51A
N
S
44B
49A
50B
48A
53A
51B
N
S
49B
53B
52A
52B
48B PRIOR ART Fig.10a PRIOR ART Fig.10b PRIOR ART Fig.10c

SWITCH WITH CONTACTS

BACKGROUND OF THE INVENTION

1. Field of the Invention

The present invention relates to a switch witho contacts which includes an electromagnetic relay having a movable contact member made of a leaf spring for switching on and off a DC current and the like.

2. Description of Prior Art

In general, in the case of switching on and off a DC current by using a relatively small electromagnetic relay in which a movable contact member is made of a leaf spring, the resistance load of about 1A at the DC voltage of 100 V is the breaking limit value. In the case of a voltage or current larger than those values, the breaking cannot be performed due to an arc when the contacts are switched off.

Therefore, hitherto, for instance, as shown in FIG. 9, an electromagnet block 104 is constructed by winding a coil 103 around an iron core 102 fixed to a yoke 101. A base end portion of a movable contact member 106 made of a leaf spring is fixed to one end portion of a movable iron member 105 which is pivotally supported to the yoke 101 at an almost central position thereof (the pivotal supporting structure is not shown in the diagram). A movable contact 111 which is come into contact with and is away from fixed contact 109 or 110 of a pair of fixed contact members 107 and 108 is attached to a tip portion of the movable contact member 106. Permanent magnets 112 and 113 are arranged at positions such as to sandwich the movable contact 111 with an interval. That is, an electromagnetic force is generated on the basis of the Fleming's left-hand rule by an arc current I (FIG. 9) which is generated when the movable contact 111 is away from (switched off) the fixed contact 109 or 110 and by a magnetic flux $\phi$ of the permanent magnets 112 and 113 in the direction perpendicular to the direction of the arc current I. An arc Q which is generated when the contact is switched off is pushed to the outside and is extinguished as shown in FIGS. 10*a* to 10*c* by such an electromagnetic force.

However, according to the above construction, one end of the arc column always exists at the movable contact 111 or movable contact member 106 as shown in FIGS. 10*a* to 10*c* for the period of time from the generation of the arc Q (at the time of the switch-off of the contact) to the extinguishment of the arc. Therefore, the movable contact 111 and movable contact member 106 are heated by the arc heat, causing the abrasion of the contacts and the deterioration of the spring characteristic of the movable contact member 106. Particularly, in the case of a large current or inductive load, since it takes a long time until the arc is extinguished, the temperature of the movable contact member 106 becomes high and the spring characteristic remarkably deteriorates, so that the switching operation is obstructed.

SUMMARY OF THE INVENTION

The present invention is made to solve the problems in the conventional switch and it is an object of the invention to provide a switch with contacts in which the abrasion of the contacts and the deterioration of the movable contact member due to the arc can be effectively prevented and the reliability can be improved.

According to the present invention, there is provided a switch with contacts comprising: fixed contact members having fixed contacts at their tip portions; movable contact members which are made of leaf springs and are arranged along the fixed contact members and in which movable contacts are attached at their tip portions so as to face the fixed contacts; and permanent magnets for generating electromagnetic forces adapted to move an arc which is generated when both of those contacts are away from each other, wherein this switch further comprises projecting portions which are formed at the tip portions of the fixed contact members so as to further extend toward the front side and movable side fixed terminal members whose base end portions are joined with the base end portions of the movable contact members and which are arranged along the movable contact members and whose tips extend until the front side of the movable contacts.

Preferably, magnetic pole means for restricting the positions where the magnetic fluxes to generate the electromagnetic force pass are arranged on both sides of the contacts.

According to the invention, the extending portions are formed at the tips of the movable side fixed terminal members to which the movable contact members are joined at their base end portions. The projecting portions are formed at the tips of the fixed contact members. Therefore, since the arc which is generated when the contacts are switched off is moved to the sides of the extending portions and projecting portions, the abnormal heating of the movable contact members by the arc decreases and the abrasion of the contacts is suppressed. The deterioration of the spring characteristic of the movable contact member can be effectively prevented.

Further, since a pair of magnetic pole means are arranged on both sides of the contact position, by properly setting and adjusting the transposing direction and distance of the arc, the damages of the inner wall of the casing and the like can be certainly prevented.

BRIEF DESCRIPTION OF THE DRAWINGS

FIGS. 10*a* to 10*c* are explanatory diagrams of a state in which an arc is extinguished in the switch shown in FIG. 9.

DETAILED DESCRIPTION OF PREFERRED EMBODIMENTS

An embodiment of the present invention will be described hereinbelow with reference to the drawings.

Figure 1:
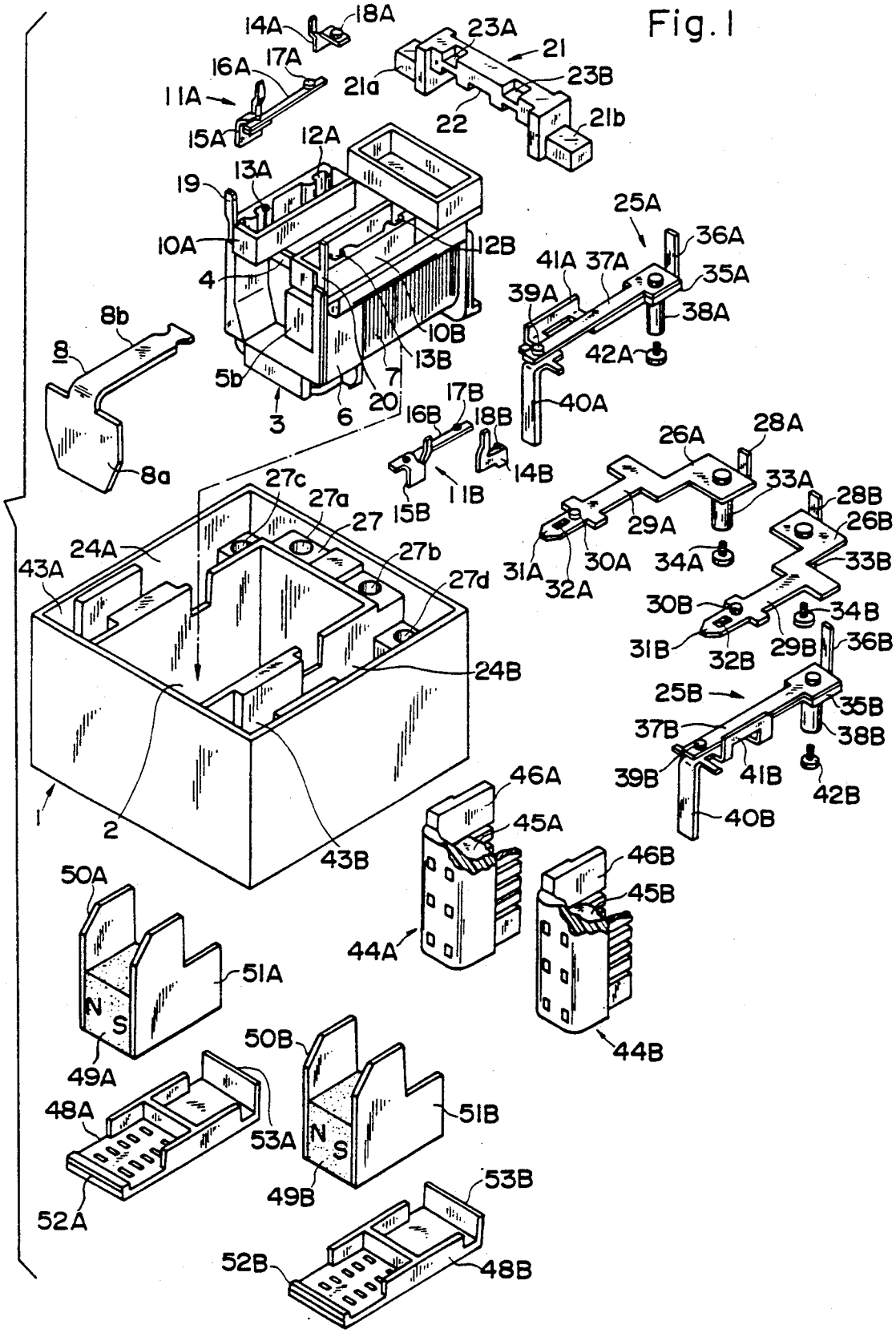
FIG. 1 is an exploded perspective view showing an example of an electromagnetic relay to which a switch with contacts according to the present invention is applied.
Figure 2:
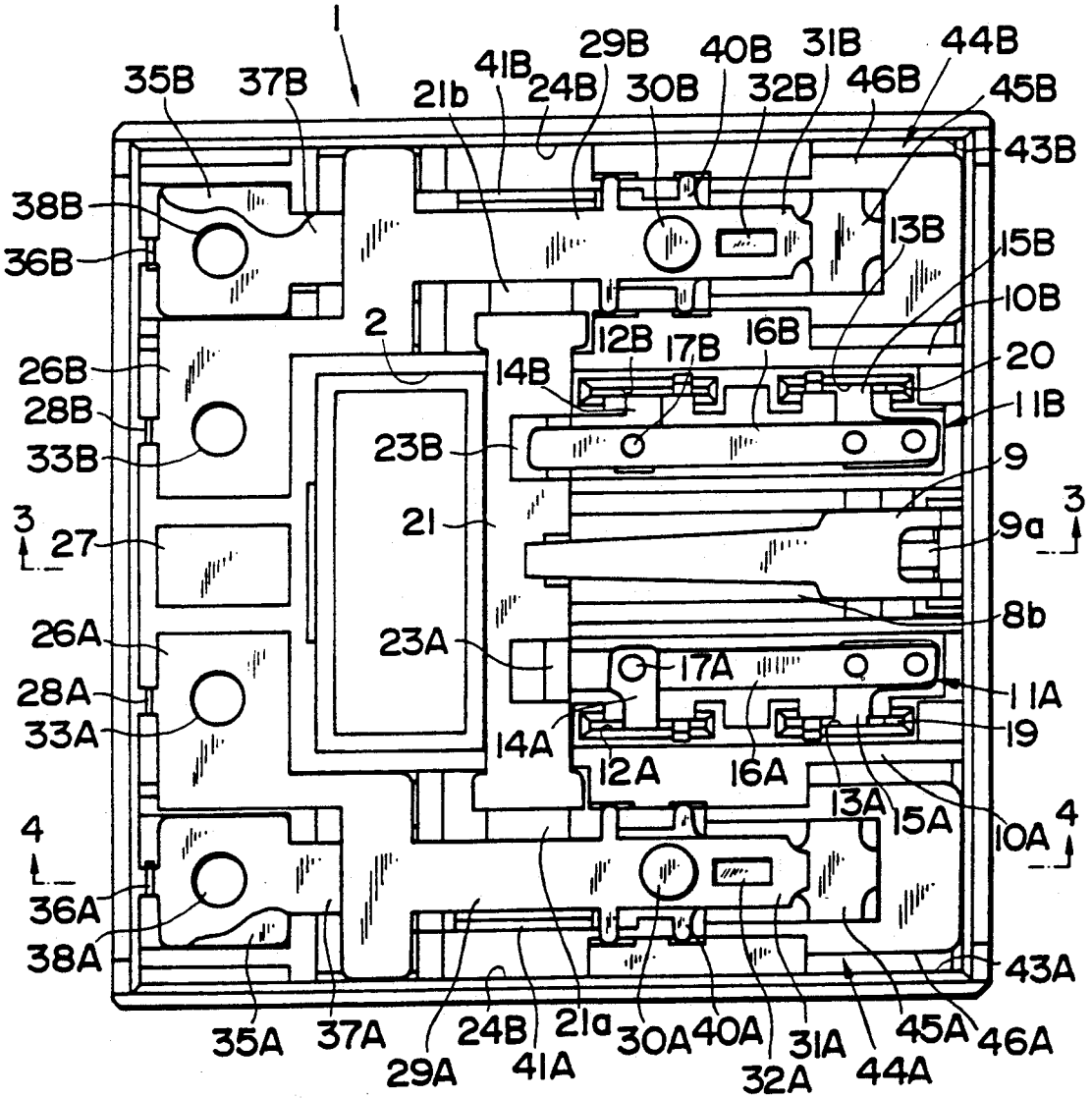
FIG. 2 is a plan view of the electromagnetic relay showing a state in which a cover is removed from the relay.

FIGS. 1 and 2 are an exploded perspective view showing an example of an electromagnetic relay to which the invention is applied and a plan view of the relay showing a state in which a cover is removed from the relay.

Figure 3:
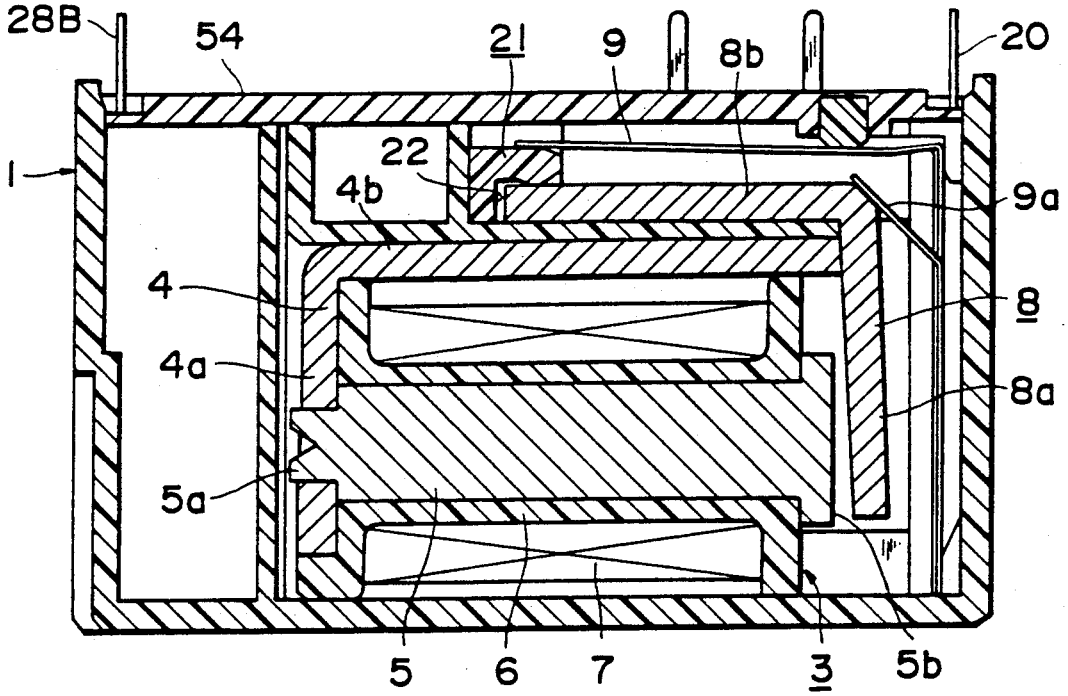
FIG. 3 is a cross sectional view taken along the line 3—3 in FIG. 2.

In the diagrams, reference numeral 1 denotes an almost box-shaped casing made of an electrically insulative synthetic resin. An electromagnet block 3 is enclosed in a concave portion 2 formed in the central portion of the casing 1. As shown in FIG. 3, the electromagnet block 3 comprises: an L-shaped yoke 4; an iron core 5 whose base end portion 5*a* is fixed to one side portion 4*a* of the yoke 4 by caulking or the like; and a coil 7 wound around the outer periphery of the iron core 5 through a coil spool 6. An almost L-shaped movable iron member 8 is swingably pivotally supported to the tip of the other side portion 4*b* of the yoke 4 at a bent portion (corner) of the movable iron member 8 (the pivotally supporting mechanism is not shown in the diagrams). One side portion 8*a* of the movable iron member 8 is arranged so as to face a front edge surface (magnetic pole surface) 5*b* of the iron core 5. Reference numeral 9 denotes a leaf spring having a pressing member 9*a* for pressing the bent portion of the movable iron member 8, thereby keeping the movable iron member 8 to a position shown in FIG. 3.

Reference numerals 10*a* and 10B denote frame portions which are located on both right and left sides of the movable iron member 8 and are formed integrally with the coil spool 6. Contact switching on/off mechanisms 11A and 11B for a small current are arranged in the frame portions 10A and 10B, respectively. The contact switching on/off mechanisms 11A and 11B are constructed in a manner such that when one of them is turned on, the other is turned off. The mechanism 11A on the left side comprises: a fixed side terminal member 14A and a movable side terminal member 15A which are respectively fitted into grooves 12A and 13A of the frame portion 10A; a movable contact member 16A supported to the movable side terminal member 15A; a movable contact 17A fixed to the tip portion of the movable contact member 16A; and a normally on type fixed contact 18A fixed to the fixed side terminal member 14A. On the other hand, the mechanism 11B on the right side comprises: a fixed side terminal member 14B and a movable side terminal member 15B which are respectively fitted into grooves 12B and 13B of the frame portion 10B; a movable contact member 16B supported to the movable side terminal member 15B; a movable contact 17B fixed to the tip portion of the movable contact member 16B; and a normally off type fixed contact 18B fixed to the fixed side terminal member 14B. Reference numerals 19 and 20 denote a pair of coil terminal members which are fixed to the coil spool 6 and connected to the coil 7.

Reference numeral 21 indicates an almost rod-shaped card which is vertically movably set and is arranged so as to transverse over the concave portion 2 in the lateral direction. An inserting portion 22 into which the tip of the other side portion 8*b* of the movable iron member 8 is inserted and held is formed in the central portion of the card 21. The card 21 is moved upward by the upward movement of the other side portion 8*b*. On the other hand, the card 21 is always pressed downward by the leaf spring 9. Stop and holding portions 23A and 23B are formed on the card 21 so as to be located on both left and right sides of the inserting portion 22. Tip portions of the movable contact members 16A and 16B are in contact with the concave portions 23A and 23B, respectively.

Concave-shaped contact mechanism enclosing portions 24A and 24B are respectively formed in the casing 1 so as to be located on both left and right sides of the concave portion 2. Contact switching on/off mechanisms 25A and 25B for a large current are arranged in the enclosing portions 24A and 24B, respectively.

Reference numerals 26A and 26B denote a pair of fixed side terminal members which are fixed to a rear edge base seat portion 27 side of the casing 1. External terminal members 28A and 28B are formed so as to upwardly extend from the fixed side terminal members 26A and 26B. Internal end portions of the terminal members 26A and 26B are extended forwardly as fixed contact members 29A and 29B. Reference numerals 30A and 30B denote normally off type fixed contacts which are directed downward and are fixed to the tip portions of the fixed contact members 29A and 29B, respectively. Projecting portions 31A and 31B which are forwardly projected are formed at the tips of the fixed contact members 29A and 29B, respectively. Further, slant members 32A and 32B which are obliquely downwardly extended from the front edge portion sides toward the fixed contacts 30A and 30B are formed on the projecting portions 31A and 31B by being cut and bent, respectively (refer to FIGS. 4 and 5).

Reference numerals 33A and 33B denote columnar socket terminals which are fixed to the fixed side terminal members 26A and 26B and are fitted into holes 27A and 27*b* of the base seat portion 27, respectively. Terminal screws 34A and 34B are threadably screwed into the socket terminals 33A and 33B, respectively.

Reference numerals 35A and 35B denote a pair of movable side terminal members which are fixed to the rear edge base seat portion 27 of the casing 1. External terminal members 36A and 36B are upwardly formed from the movable side terminal members 35A and 35B, respectively. Movable contact members 37A and 37B are arranged along the fixed contact members 29A and 29B. When the card 21 is upwardly moved, the movable contact members 37A and 37B are pushed up by both end portions 21*a* and 21*b* of the card 21. Base end portions of the movable contact members 37A and 37B are joined to the movable side terminal members 35A and 35B and are caulked and fixed to columnar socket terminals 38A and 38B fitted into holes 27*c* and 27*d* of the base seat portion 27, respectively. Reference numerals 39A and 39B denote movable contacts fixed to the tip portions of the movable contact members 37A and 37B so as to face the fixed contacts 30A and 30B, respectively.

Inner edges of the movable side terminal members 35A and 35B are extended as extending portions 40A and 40B along the movable contact members 37A and 37B toward the front side than the positions where the movable contacts 39A and 39B are provided. These inner edges are almost perpendicularly bent along the vertical direction. (Refer to FIGS. 4 and 5.) The movable side terminal members 35A and 35B are notched so as not to obstruct that the card 21 is come into contact with the movable contact members 37A and 37B at the crossing positions between the card 21 and the both end portions 21*a* and 21*b* of the card 21 and the terminal members 35A and 35B, and are respectively coupled by standing-shaped bypass coupling member portions 41A and 41B. Reference numerals 42A and 42B denote terminal screws which are threadably screwed into the columnar socket terminals 38A and 38B.

The contact switching on/off mechanism 25A is constructed by the fixed side terminal member 26A, fixed contact member 29A, fixed contact 30A, movable side terminal member 35A, movable contact member 37A, movable contact 39A, and the like. The other contact switching on/off mechanism 25B is constructed by the fixed side terminal member 26B, fixed contact member 29B, fixed contact 30B, movable side terminal member 35B, movable contact member 37B, movable contact 39B, and the like.

Arc-extinguishing apparatuses 44A and 44B are enclosed in housing portions 43A and 43B formed on both left and right sides on the front edge side of the casing 1, respectively. The arc-extinguishing apparatuses 44A and 44B are constructed by: a plurality of arc-extinguishing plates 45A and 45B arranged like a stairway; and insulative supporting members 46A and 46B to support the plates 45A and 45B, respectively. By inserting the arc-extinguishing apparatuses 44A and 44B as units from opening portions 47A and 47B (FIG. 6) of the housing portions 43A and 43B, the assembling works are simplified. Reference numerals 48A and 48B denote small covers to close the opening portions 47A and 47B such that they can be opened and closed, respectively.

Figure 4:
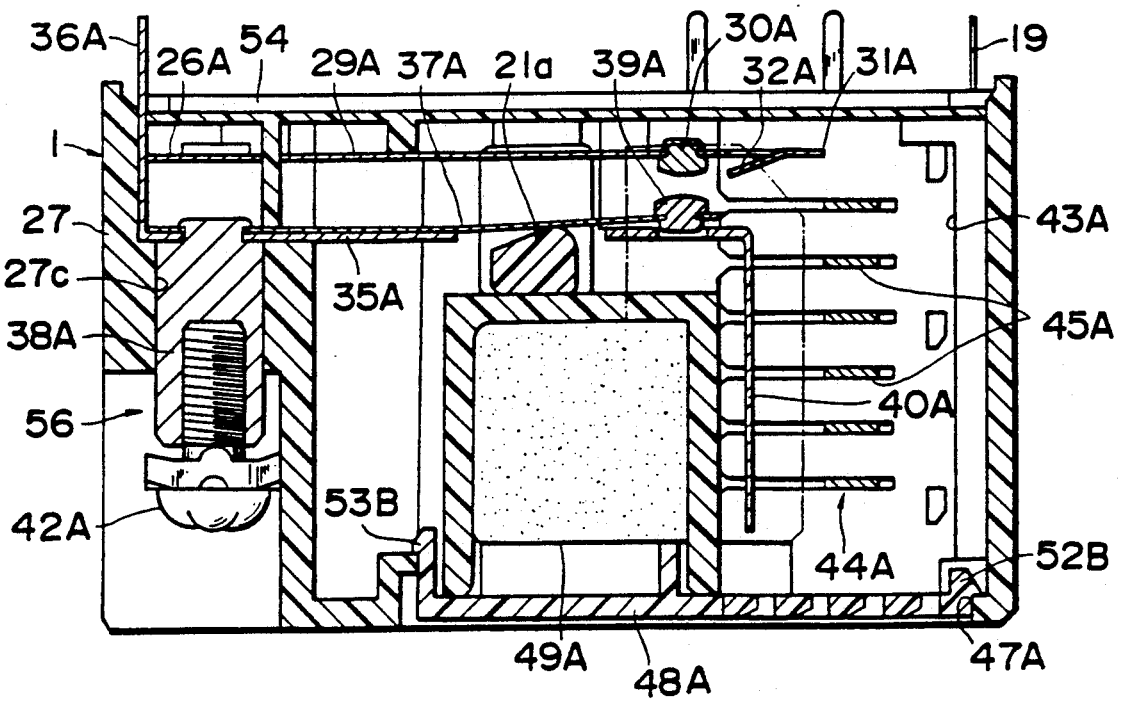
FIG. 4 is a cross sectional view taken along the line 4–4 in FIG. 2.
Figure 5:
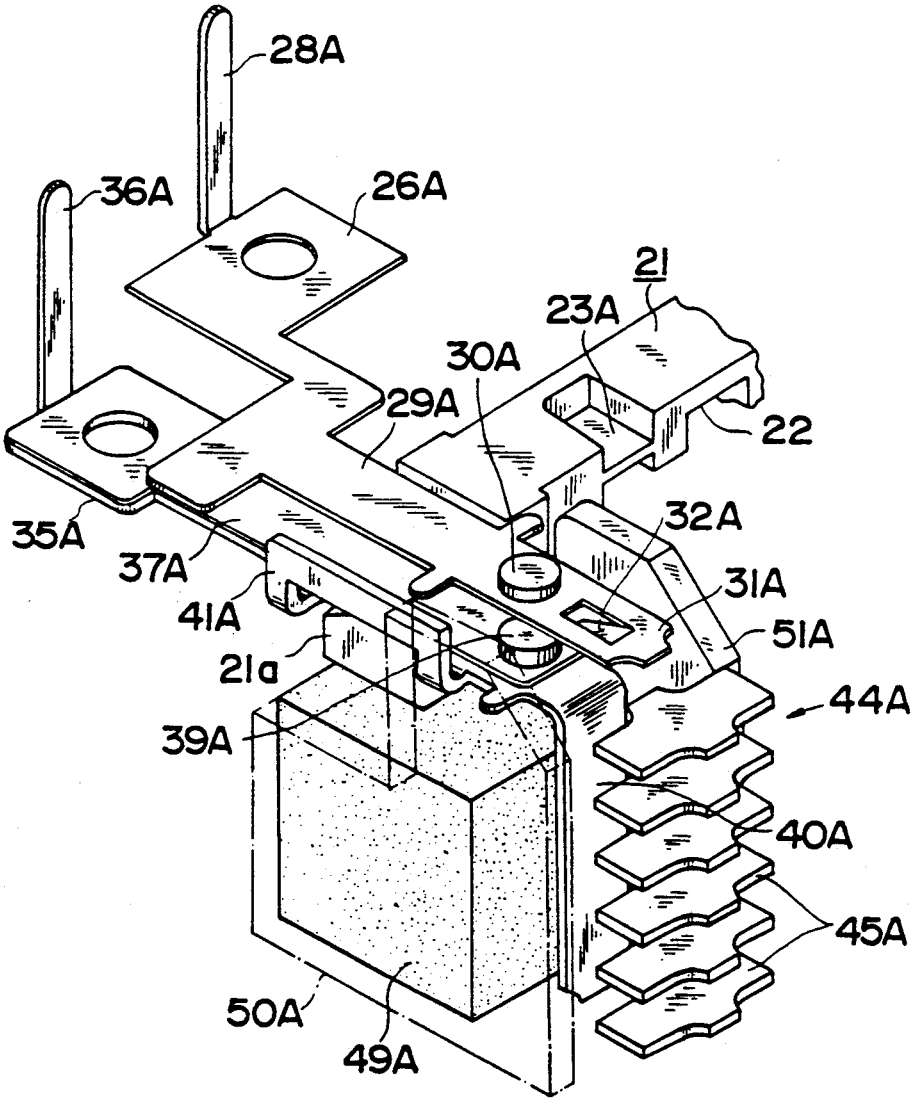
FIG. 5 is a perspective view showing a construction of the main section of the relay.

In correspondence to the contact switching on/off mechanisms 25A and 25B, permanent magnets 49A and 49B are arranged in the casing 1 at the positions near the contacts, for instance, at the inside positions of the extending portions 40A and 40B of the movable side terminal members 35A and 35B as shown in FIGS. 4 and 5, respectively. Magnetic pole surfaces are set on both side surfaces in the lateral direction of the permanent magnets 49A and 49B so as to produce the magnetic fluxes such as to generate the electromagnetic force to move the arc generated due to the contact switching-off operation to the front side, that is, to the sides of the arc-extinguishing apparatuses 44A and 44B by the magnetic fluxes of the permanent magnets 49A and 49B. Reference numerals 50A and 51A denote a pair of magnetic pole plates which are arranged on both sides of the positions where the contacts are provided. The magnetic pole plates 50A and 51A are arranged so as to face each other and are in contact with the left and right magnetic pole surfaces of the permanent magnet 49A. For instance, iron members are used as the magnetic pole plates 50A and 51A. Reference numerals 50B and 51B likewise denote a pair of magnetic pole plates such as iron members which are arranged on both sides of the positions where the contacts are provided. The magnetic pole plates 50B and 51B are arranged so as to face each other and are in contact with the left and right magnetic pole surfaces of the other permanent magnet 49B: The electromagnetic force to move the arc to the front side and the movable distance of the arc are adjusted by the iron members 50A (50B) and 51A (51B).

Figure 6:
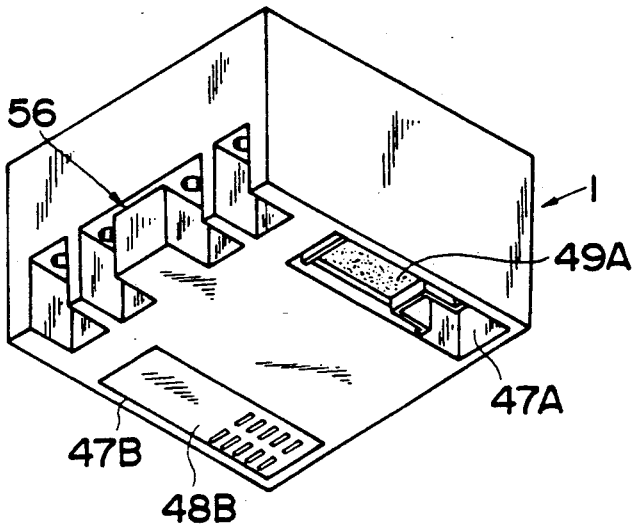
FIG. 6 is a perspective view showing the bottom surface side of the relay.

In FIG. 1, reference numerals 52A and 53A denote stop and holding portions formed on the small cover 48A and reference numerals 52B and 53B indicate stop and holding portions formed on the small cover 48B, respectively. On the other hand, in FIGS. 3 and 4, reference numeral 54 denotes a cover fitted onto the casing 1. In FIGS. 4 and 6, reference numeral 56 denotes an electric wire connecting portion formed to the casing main body 1.

The operation of the above construction will now be described.

When the coil 7 is excited, one side portion 8*a* of the movable iron member 8 is attracted to the front edge surface 5*b* of the iron core 5. Thus, the movable iron member 8 rotates against the pressing force of the spring 9 by using the edge of the other side portion 4*b* of the yoke 4 as a rotational fulcrum, thereby moving the card 21 upward. Therefore, the contact switching on/off mechanism 11A to switch on/off the small current is closed (is set to on) and the contact switching on/off mechanism 11B is opened (is set to off).

On the other hand, the movable contact members 37A and 37B in the contact switching on/off mechanisms 25A and 25B for switching on/off a large current are also driven by both end portions 21*a* and 21*b* of the card 21, respectively. Since the operations of the mechanisms 25A and 25B are the same, the operation of only the mechanism 25A will be described hereinbelow as an example. That is, the portion between the movable contact 39A and the normally off type fixed contact 30A is closed by the upward movement of the movable contact member 37A. When the excitation of the coil 7 is released, the portion between the movable contact 39A and the fixed contact 30A is opened by the operation opposite to the above.

Figure 7A:
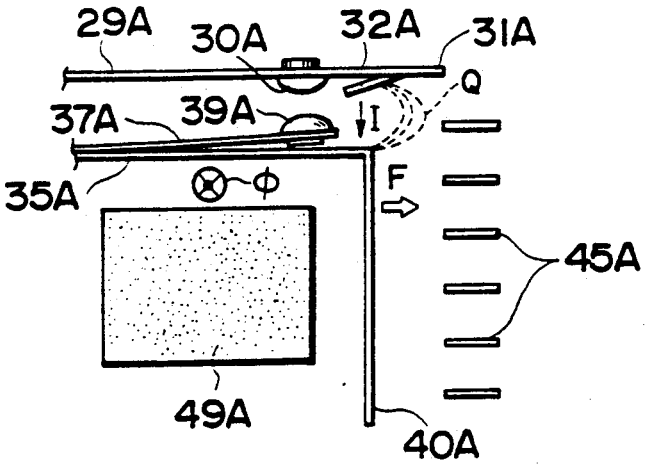
FIGS. 7*a* and 7*b* are diagrams for explaining the operation of the main section of the relay, respectively.
Figure 7B:
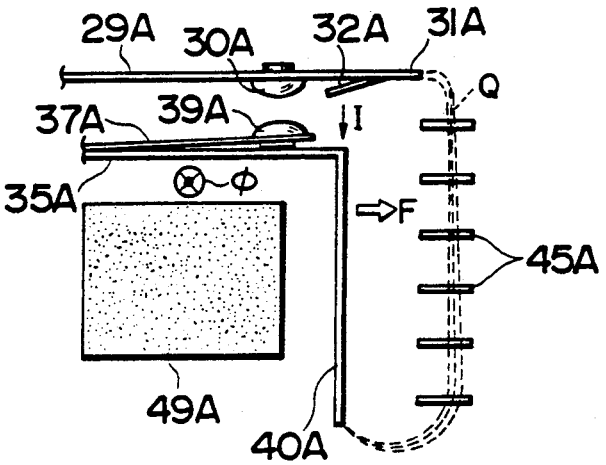

When an arc is generated between both contacts 30A and 39A at the time of the switching off thereof, as shown in FIG. 7*a*, the arc Q starts moving to the front side due to the electromagnetic force F which is generated by the arc current I and the magnetic flux $\phi$ of the permanent magnet 49A on the basis of Fleming's left-hand rule. Because of the existence of the projecting portion 31A formed at the tip of the fixed contact member 29A and the extending portion 40A formed at the tip of the movable side terminal member 35A, the arc Q is transposed to both the projecting portion 31A and extending portion 40A, so that the arc column is extended. Therefore, at an early time, the arc Q is away from the fixed contact member 29A and from the movable contact member 37A and moves to the arc-extinguishing plate 45A side as shown in FIG. 7*b*. Thus, the situation such that the contacts 30A and 39A and movable contact member 37A are abnormally heated by the arc Q is eliminated. The abrasion of the contacts 30A and 39A is prevented. The spring characteristic of the movable contact member 37A is effectively held. In other words, the repetitive switching on/off operations of a large current can be also executed without a trouble.

Particularly, in the embodiment, since the projecting portion 31A is formed with the slant member 32A, the arc Q between the contacts easily moves to the projecting portion 31A side by using the slant member 32A as an arc runner. On the other hand, since the extending portion 40A of the movable side terminal member 35A is bent, the extending operation to elongate the arc column increases and the heat preventing effect is enlarged. The extending portion 40A is not limited to the bent portion.

On the other hand, when the electromagnetic force F to move the arc Q to the front side becomes too large, there is a fear such that the inner wall of the casing 1 is burned lost. However, in the above construction, since the iron members 50A and 51A are provided on both sides of the permanent magnet 49A, by adjusting the projecting lengths or the like in the front to back direction of the iron members 50A and 51A, the moving distance of the arc Q to the front side can be restricted, so that there is no fear of burning loss or the like of the casing 1 and the effective arc-extinguishing effect is obtained.

Figure 8:
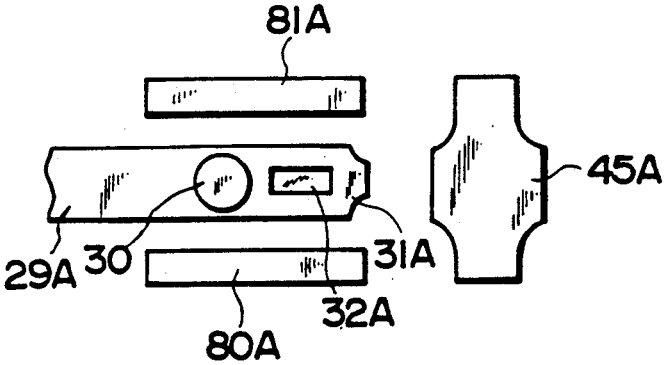
FIG. 8 is an explanatory diagram of a modified structure of the main section of the relay.
Figure 9:
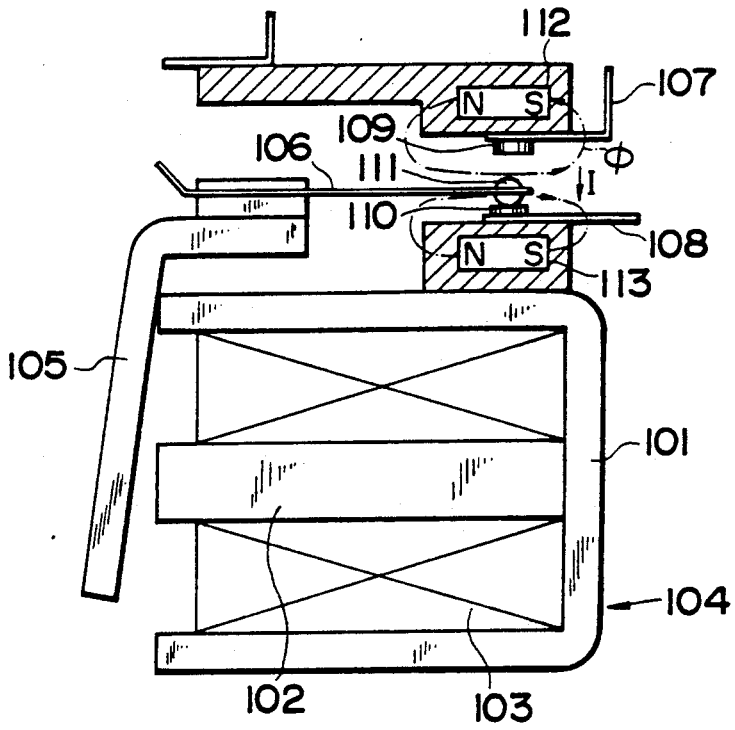
Fig.9 PRIOR ART
FIG. 9 is a schematic constructional diagram of the main section of a conventional switch with contacts.
Figure 9:
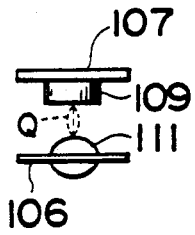
Fig.9 PRIOR ART
Figure 9:
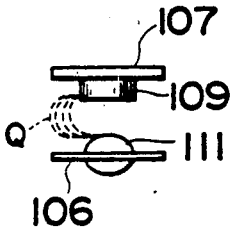
Fig.9 PRIOR ART
Figure 9:
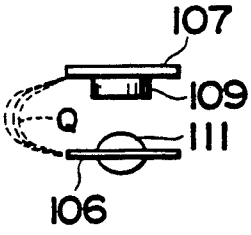
Fig.9 PRIOR ART

In the embodiment, the moving direction and moving distance of the arc Q have been controlled by the permanent magnet 49A (49B) and the pair of iron members 50A (50B) and 51A (51B). However, as shown in FIG. 8, the arc Q can be also controlled by permanent magnets 80A and 81A arranged on both sides of the contact position. In brief, it is sufficient that the magnetic pole surfaces are arranged at least on both sides of the contact position.

What is claimed is:

1. A switch with contacts comprising:

at least one fixed contact member having a tip portion;

a fixed contact disposed at the tip portion of said at least one fixed contact member;

at least one moveable contact member arranged along said at least one fixed contact member and comprising a leaf spring having a tip portion;

a moveable contact disposed at the tip portion of said at least one moveable contact member and facing said fixed contact;

arc extinguishing means for extinguishing an arc generated when said moveable contact moves away from said fixed contact;

means for moving the arc towards said arc extinguishing means, wherein said means for moving comprising a magnet;

a projecting portion formed at said tip portion of said at least one fixed contact member so as to further extend the fixed contact member past the fixed contact; and at least one moveable side fixed terminal member arranged along said at least one moveable contact member and comprising:

a base end portion joined to a base end portion of said at least one moveable contact member, and a tip portion extending past the moveable contact of said at least one moveable contact member.

2. A switch according to claim 1, further comprising a slant member formed to the projecting portion of said at least one fixed contact member, wherein said slant member is directed to an apex portion of said fixed contact.

3. A switch as claimed in claim 1, wherein said means for removing an arc further comprises magnetic pole means for restricting an area of applied magnetic flux, wherein said magnetic pole means comprises a pair of pole plates arranged on two sides of said at least one magnet.

4. A switch as claimed in claim 1, wherein said tip portion of said at least one moveable side fixed terminal member comprises an extending portion which is bent at a substantially right angle, and wherein said arc extinguishing means comprises at least one arc extinguishing plate arranged between said extending portion and said projecting portion of said at least one fixed contact member.

5. A switch as claimed in claim 4, wherein said arc extinguishing plate comprise guide means for guiding the arc and confining the arc to the arc extinguishing means, wherein said guiding means comprises at least one projecting portion.

6. A switch as claimed in claim 1, wherein said switch is designed to switch direct current.

* * * * *